US006964293B2

(12) United States Patent
Ban et al.

(10) Patent No.: US 6,964,293 B2
(45) **Date of Patent: *Nov. 15, 2005**

(54) METHOD OF CASTING AND CASTING MACHINE

(75) Inventors: Keisuke Ban, Nagano (JP); Akira Sunohara, Nagano (JP); Yasuhiro Sasaki, Nagano (JP); Koichi Ogiwara, Nagano (JP); Sakuzo Nakatani, Nagano (JP)

(73) Assignee: Nissin Kogyo Co., Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/858,478

(22) Filed: Jun. 2, 2004

(65) Prior Publication Data

US 2005/0000672 A1 Jan. 6, 2005

Related U.S. Application Data

(62) Division of application No. 09/852,267, filed on May 10, 2001, now Pat. No. 6,745,816.

(30) Foreign Application Priority Data

May 10, 2000 (JP) ..... 2000-137799
Jan. 25, 2001 (JP) ..... 2001-016858
Jan. 30, 2001 (JP) ..... 2001-021277

(51) Int. Cl.[7] ..... B22D 27/00; B22C 9/08

(52) U.S. Cl. ..... 164/312; 164/359

(58) Field of Search ..... 164/56.1, 66.1, 164/67.1, 61, 122.1, 359, 360, 312

(56) References Cited

U.S. PATENT DOCUMENTS 2,770,860 A 11/1956 Webbere
2,865,736 A 12/1958 Beaver, Jr.
3,302,919 A 2/1967 Beetle et al.

(Continued)

FOREIGN PATENT DOCUMENTS

EP 0 913 215 A1 5/1999

(Continued)

OTHER PUBLICATIONS

Darken et al., "Physical Chemistry of Metals", the standard free energy of formation of many metal oxides as a function of temperature, McGraw Hill, 1953, p. 349.

*Primary Examiner*—Kuang Y. Lin
(74) *Attorney, Agent, or Firm*—Greenblum & Bernstein, P.L.C.

(57) ABSTRACT

The method of casting of the present invention is capable of making volume of a feeder head can be small and making cooling rate of the feeder head can be easily made lower than that of a cavity. The method is executed in a casting machine, which includes a casting die, in which the feeder head is provided between a metal inlet and the cavity and in which heat insulating of the feeder head is greater than that of the cavity so as to make cooling rate of the feeder head lower than that of the cavity. The method comprises the steps of: pouring a molten metal into the cavity; reacting the molten metal on a deoxidizing compound in the cavity so as to deoxidize an oxide film formed on a surface of the molten metal; and supplementing the molten metal in the feeder head to the cavity when the molten metal in the cavity is solidified and shrinked.

17 Claims, 8 Drawing Sheets

U.S. PATENT DOCUMENTS

| | | | | |
|---|---|---|---|---|
| 3,364,976 | A | | 1/1968 | Reding et al. |
| 3,650,313 | A | | 3/1972 | Balevski et al. |
| 3,900,305 | A | | 8/1975 | DeLuca |
| 4,245,691 | A | | 1/1981 | Mohla |
| 4,424,853 | A | * | 1/1984 | Khandros et al. ..... 164/57.1 |
| 4,811,782 | A | | 3/1989 | Sola |
| 4,871,008 | A | | 10/1989 | Dwivedi et al. |
| 4,907,640 | A | | 3/1990 | Jeanneret |
| 4,913,218 | A | | 4/1990 | Seidinger |
| 5,314,525 | A | | 5/1994 | Eckert et al. |
| 5,647,426 | A | | 7/1997 | Prieto et al. |
| 5,896,912 | A | | 4/1999 | Monroe et al. |
| 5,934,355 | A | | 8/1999 | Nakao et al. |
| 5,954,113 | A | | 9/1999 | Buchborn |
| 6,171,363 | B1 | | 1/2001 | Shekhter et al. |

FOREIGN PATENT DOCUMENTS

| | | |
|---|---|---|
| JP | 03-230843 | 10/1991 |
| JP | 11-036975 | 2/1999 |
| JP | 2000-108078 | 4/2000 |

* cited by examiner

METHOD OF CASTING AND CASTING MACHINE

CROSS REFERENCE TO RELATED APPLICATIONS

This application is a divisional application of U.S. patent application Ser. No. 09/852,267, filed on May 10, 2001 and which issued as U.S. Pat. No. 6,745,816, which is incorporated herein by reference in its entirety.

BACKGROUND OF THE INVENTION

The present invention relates to a method of casting and a casting machine, more precisely relates to a method of casting and a casting machine, in each of which a molten metal is poured into a cavity of a casting die so as to cast a product having a prescribed shape.

Many kinds of ways of aluminium casting. For example, gravity casting has some advantages: simple casting dies, high quality products, etc.

The casting die of the gravity casting is shown in FIG. 10. In FIG. 10, the casting die 100 is made of a metal. The casting die 100 is a splittable die constituted by a lower die 102*a* and an upper die 102*b*. A cavity 104, in which a product having a prescribed shape is cast, is formed by the lower die 102*a* and the upper die 102*b*.

The upper die 102*b* includes: a metal inlet 106, from which a molten metal, e.g., a molten aluminium, a molten aluminium alloy, is poured into the cavity 104; a feeder head 108 provided between the metal inlet 106 and the cavity 104; and air ventilation holes 110, from which air in the cavity 104 is discharged when the molten metal is poured into the cavity 104.

When the molten aluminium or aluminum alloy is solidified, its volume is reduced about 3% due to shrinkage. The shrinkage of the solidified metal in the cavity occurs a surface sink, etc. in the cast product. In the casting die 100 shown in FIG. 10, a gap, which is formed in the cavity 104 by the shrinkage of the solidified metal, is filled with a part of the molten metal in the feeder head 108, so that the defect, e.g., the surface sink, can be prevented.

Surface tension of the molten aluminium or aluminium alloy is made greater by an oxide film formed on a surface of the molten aluminium or aluminium alloy. Therefore, fluidity and running property of the molten aluminium or aluminium alloy are low, and smoothness of a surface of the product is also low. To solve these disadvantages, inner faces of the feeder head 108 and the cavity 104 of the casting die 100 shown in FIG. 10 are coated with lubricant so as to improve the fluidity and the running property of the molten metal whose surface is covered with the oxide film.

When the product is cast by the casting die 100 shown in FIG. 10, the molten aluminum or aluminium alloy is poured into the metal inlet 106 of the casting die 100. The cavity 104 and the feeder head 108 are filled with the molten aluminium or alulminium alloy with discharging the air from the air ventilation holes 110.

Next, the casting die 100, in which the molten metal has been filled, is cooled so as to solidify the molten metal in the cavity 104. By the solidification of the molten metal in the cavity 104, the solidified metal is shrinked and the gap is formed in the cavity 104, but the gap in the cavity 104 is filled with the molten metal supplied from the feeder head 108.

However, in the conventional method of aluminium casting shown in FIG. 10, the inner faces of the feeder head 108 and the cavity 104 must be coated with the lubricant so as to improve the fluidity and the running property of the molten metal whose surface is covered with the oxide film. But, it is very difficult for inexperienced workers to define coating portions and to uniformly form coating layers. Therefore, surface defects of cast products, e.g., rough surfaces, cannot be avoided.

The inventors of the present invention invented and filed an improved method of aluminum casting (Japanese Patent Application No. 2000-108078), in which aluminium products having good and smooth surfaces can be cast without coating any lubricant.

The improved method will be explained with reference to FIG. 11. Firstly, a magnesium nitride compound ($Mg_3N_2$), which is an example of deoxidizing compounds, is introduced into the cavity 104 of the casting die 100, then the molten aluminium or aluminium alloy is poured therein.

In the improved method, the deoxidizing compound is previously existed in the cavity 104 of the casting die 100, so that the oxide film formed on the surface of the molten aluminium or aluminium alloy can be deoxidized and the surface tension of the molten aluminium or aluminium alloy can be made lower. By deoxidizing or removing the oxide film, the fluidity and the running property of the molten metal can be improved, so that surfaces of the cast products can be smooth and can have good external surfaces.

The feeder head 108 shown in FIG. 10 or 11 is capable of filling the gap, which is formed in the cavity 104 when the solidified metal is shrinked, with the molten metal. Therefore, at least a part of the molten metal in the feeder head 108 must have enough fluidity, even if the molten metal in the cavity 104 is solidified.

Namely, solidifying speed of the molten metal in the feeder head 108 must be lower than that of the molten metal in the cavity 104. Thus, cooling rate of the feeder head must be lower than that of the cavity. To make the difference of the cooling rate, the feeder head 108 is formed into, for example, a pillar shape having broad traverse sectional area. By the pillar-shaped feeder head 108, the molten metal in the feeder head 108 is not easily cooled.

However, the solidified metal in the feeder head 108 is a disused part, so it will be removed from the product. If the solidified metal in the feeder head 108 is reused, it must be molten and energy must be consumed.

Therefore, the pillar-shaped feeder head 108, which has broad traverse sectional area, has greater volume, so yield of casting material must be lower and energy consumption for reuse must be greater.

SUMMARY OF THE INVENTION

An object of the present invention is to provide a method of casting, in which volume of a feeder head can be small and cooling rate of the feeder head can be easily made lower than that of a cavity.

Another object of the present invention is to provide a casting machine, which is capable of executing the method of the present invention.

The inventors studied to achieve the objects, and they found that: in their improved method shown in FIG. 11, the deoxidizing compound existed in the cavity 104 of the casting die 100 deoxidizes the oxide film on the surface of the molten meal, so the molten metal has high fluidity on the inner face of the cavity 104, which is not coated with the lubricant; and the cooling rate of the molten metal in the cavity 104, whose inner face is coated with no lubricant, is greater than that of the molten metal in the cavity, whose inner face is coated with the lubricant.

To make a difference of heat insulating between the feeder head 108 and the cavity 104 which are made of the same material, an inner face of the feeder head 108 is coated with the lubricant, and an inner face of the cavity 104 is coated with no lubricant, so that the heat insulating of the feeder head 108 can be made greater than that of the cavity 104.

With this structure, the cooling rate of the feeder head 108 can be lower than that of cavity 104, so that solidification speed of the molten metal in the feeder head 108 can be slower than that of the molten metal in the cavity 104. Then, the inventors reached the present invention.

The method of casting of the present invention is executed in a casting machine including a casting die, in which a feeder head is provided between a metal inlet and a cavity and in which heat insulating of the feeder head is greater than that of the cavity so as to make cooling rate of the feeder head lower than that of the cavity, and said method comprises the steps of:

pouring a molten metal into the cavity;

reacting the molten metal on a deoxidizing compound in the cavity so as to deoxidize an oxide film formed on a surface of the molten metal; and supplementing the molten metal in the feeder head to the cavity when the molten metal in the cavity is solidified and shrinked.

On the other hand, the casting machine of the present invention comprises a casting die, which includes:

a metal inlet, from which a molten metal is poured into the casting die;

a cavity, in which the molten metal is solidified so as to cast a product; and a feeder head being provided between the metal inlet and the cavity, in which heat insulating of the feeder head is greater than that of the cavity so as to make cooling rate of the feeder head lower than that of the cavity, wherein the molten metal is reacted on a deoxidizing compound in the cavity so as to deoxidize an oxide film formed on a surface of the molten metal, and the molten metal in the feeder head is supplemented to the cavity when the molten metal in the cavity is solidified and shrinked.

In the present invention, the molten metal is reacted on the deoxidizing compound in the cavity of the casting die, and the oxide film formed on the surface of the molten metal can be deoxidized, so that the fluidity of the molten metal can be higher and the product can be cast in the cavity, whose inner face is exposed. Therefore, the lubricant, which improves the fluidity of the molten metal whose surface is covered with the oxide film, is not required.

The lubricant usually has heat insulating, so heat-radiating property of the cavity, whose inner face is coated with the lubricant, is made lower. On the other hand, in the present invention, the molten metal is filled in the cavity, whose inner face is coated with no lubricant, the heat-radiating property can be highly improved. Therefore, the heat-radiating property of the cavity of the casting die of the present invention can be easily made high, and the heat insulating of the feeder head can be easily made greater than that of the cavity by coating the inner face of the feeder head with the heat insulating lubricant.

Despite the feeder head is made small, the heat insulating of the feeder head can be greater than that of the cavity, the cooling rate of the feeder head can be made lower than that of the cavity, a difference of the cooling rate between the molten metal in the feeder head and the molten metal in the cavity can be greater, and a difference of solidification speed there between can be made.

BRIEF DESCRIPTION OF THE DRAWINGS

Embodiments of the present invention will now be described by way of examples and with reference to the accompanying drawings, in which.

DETAILED DESCRIPTION OF THE PREFERRED EMBODIMENTS

Preferred embodiments of the present invention will now be described in detail with reference to the accompanying drawings.

Figure 1:
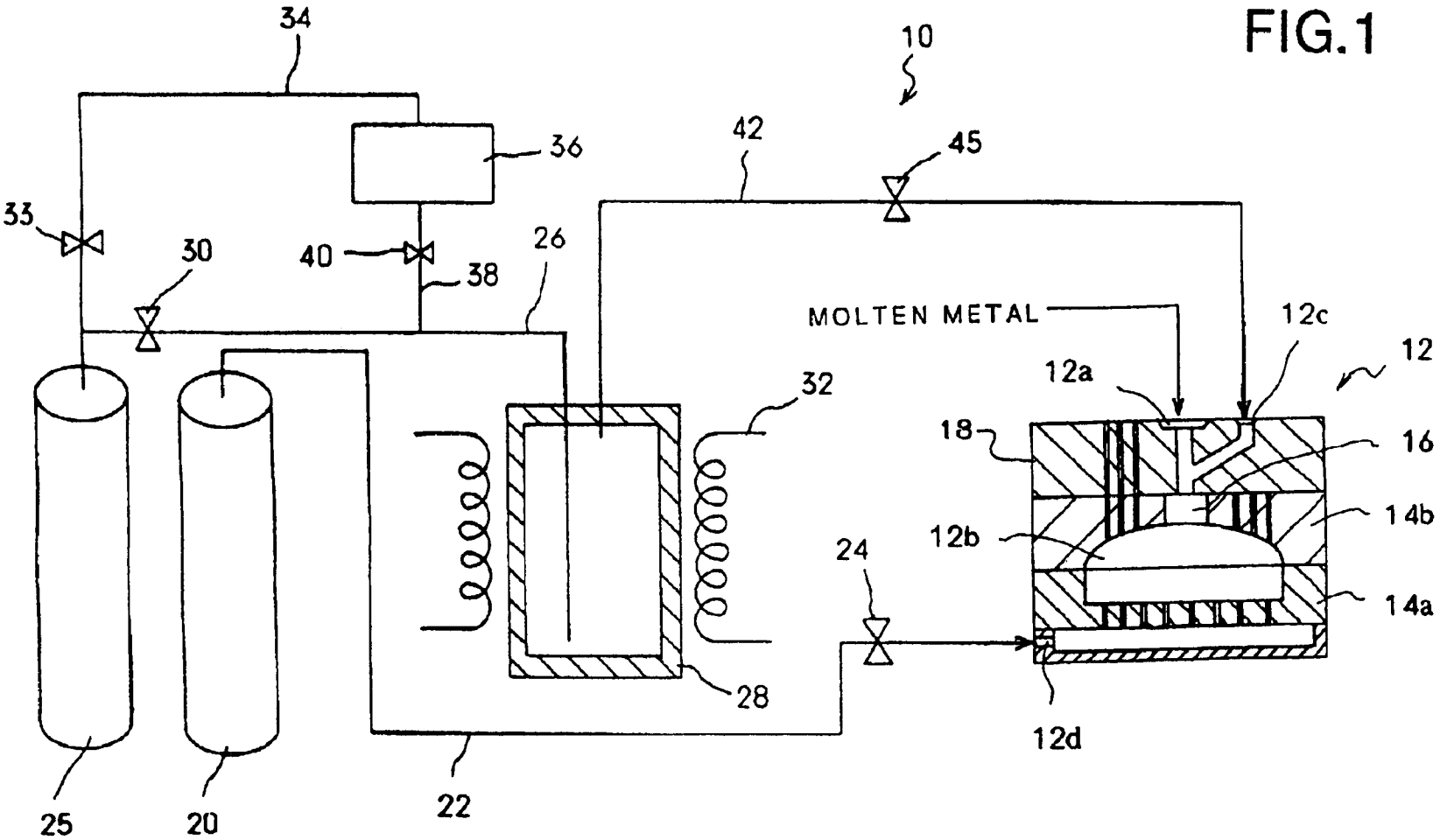
FIG. 1 is an explanation view showing an outline of an embodiment of the casting machine of the present invention.

An outline of a casting machine of an embodiment is shown in FIG. 1. In FIG. 1, the casting machine 10 has a casting die 12. The casting die 12 has a metal inlet 12*a*, from which a molten metal, e.g., aluminium, aluminium alloy, is poured, and a cavity 12*b*, which is communicated to the metal inlet 12*a*. The casting die 12 includes a lower die 14*a* and an upper die 14*b*. Metals, which respectively constitute the lower and upper dies 14*a* and 14*b*, are exposed in inner faces of the cavity 12*b*.

The casting die 12 is connected to a nitrogen cylinder 20 by a pipe 22. By opening a valve 24 of the pipe 22, a nitrogen gas is introduced into the cavity 12*b* via a nitrogen gas inlet 12*d*, so that the cavity 12*b* is filled with the nitrogen gas and non-oxygen atmosphere is produced therein.

An argon gas cylinder 25 is connected to a furnace 28, in which a metallic gas is generated, via a pipe 26. By opening a valve 30 of the pipe 26, an argon gas is introduced into the furnace 28. An inner space of the furnace 28 is heated by heaters 32 until reaching temperature of 800° C. or more so as to sublime magnesium powders. By subliming the magnesium powders, a magnesium gas is generated as the metallic gas.

Amount of the argon gas, which is introduced into the furnace 28, can be controlled by adjusting the valve 30.

The argon gas cylinder 25 is connected to a tank 36, in which the magnesium powders are stored, via a pipe 34, to which a valve 33 is provided. The tank 36 is connected to the pipe 26 via a pipe 38. A connecting point of the pipes 26 and 38 is located on the furnace 28 side with respect to the valve 30. A valve 40 is provided to the pipe 38. The furnace 28 is connected to a metallic gas inlet 12*c* of the casting die 12 via a pipe 42. The metallic gas, which has been generated in the furnace 28 is introduced into the cavity 12*b* via the metallic gas inlet 12*c*. A valve 45 is provided to the pipe 42.

When the argon gas is introduced from the argon gas cylinder 25 to the cavity 12*b* of the casting die 12 via the furnace 28, amount of the argon gas, which is introduced into the cavity 12*b*, can be controlled by adjusting the valve 45.

Figure 2A:
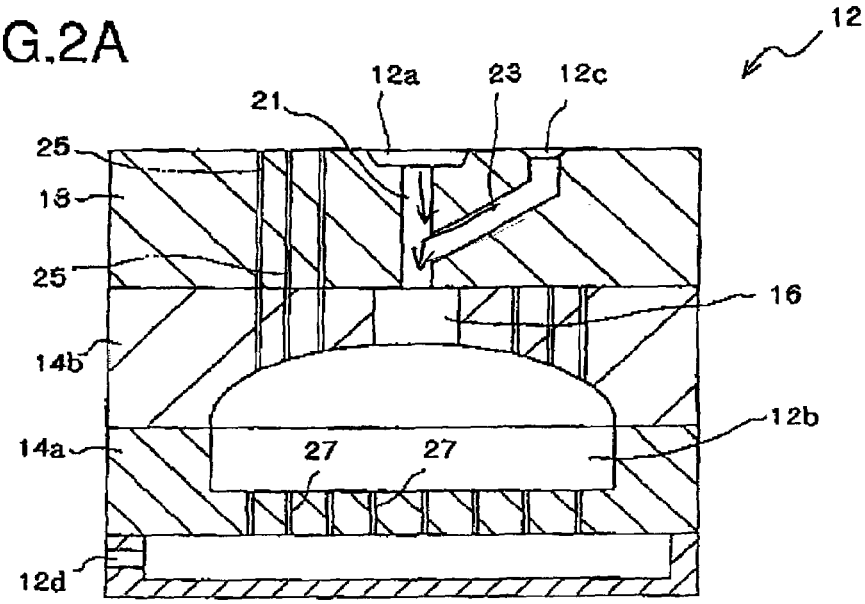
FIG. 2A is a sectional view of a casting die of the casting machine shown in FIG. 1.

As shown in FIG. 2A, the casting die 12 shown in FIG. 1 is a splittable die and constituted by the metallic lower die 14*a*, the metallic upper die 14*a* and an adapter 18, which is made of baked calcium sulfate. The cavity 12, in which a product having a prescribed shape is cast, is formed by inner faces of the lower and upper dies 14*a* and 14*b*.

In the adapter 18, a metal path 21 and a feeder head 16, which introduce the molten metal from the metal inlet 12*a* to the cavity 12*b*, are formed between the metal inlet 12*a* and the cavity 12*b*. Preferably, transverse sectional area of the feeder head 16 is broader than that of the path 21, and volume of the feeder head 16 is 5–20% of volume of the cavity 12*b*.

A metallic gas path 23, whose upper end is the metallic gas inlet 12*c*, is communicated to the path 21.

Air ventilation holes 25, which are capable of discharging air from the cavity 12*b*, are formed in the adapter 18 and the upper die 14*b*. Nitrogen gas paths 27, which is capable of introducing the nitrogen gas into the cavity 12*b*, are formed in the lower die 12*a*.

Figure 2B:
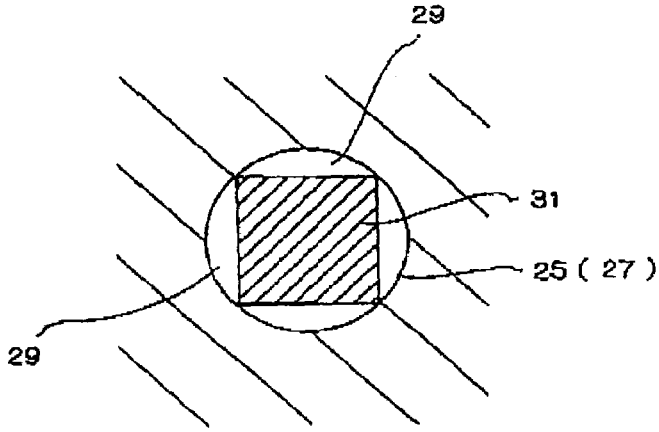
FIG. 2B is a partial sectional view of a casting die of the casting machine shown in FIG. 1.

As shown in FIG. 2B, a sectional shape of each air ventilation hole 25 or each nitrogen gas path 27 is a circular shape, and a pillar-shaped member 31, whose sectional shape is a rectangular shape, is inserted therein. With this structure, dome-shaped paths 29 are formed and communicated to the cavity 12*b*.

In the casting die 12 shown in FIGS. 1–2B, the adapter 18, which is made of the baked calcium sulfate, includes the metal inlet 12*a*, the metal path 21, the metallic gas inlet 21*c*, the metallic gas path 23 and parts of the air ventilation holes 25. The path 21, etc. are arranged on the basis of a shape of the cavity 12*b*, positions of ejector pins (not shown) for electing the cast product, etc. By forming the path 21, etc. in the adapter 18, they can be easily designed.

The adapter 18 may be made of a metallic material as well as the lower and the upper dies 14*a* and 14*b*. In the present embodiment, the adapter 18 is made of the baked calcium sulfate, so the metal path 21, etc. can be formed easily.

In the casting die 12 shown in FIGS. 1–2B, heat insulating of the feeder head 16 is greater than that of the cavity 12*b*. Namely, a heat insulating treatment, e.g., coating heat insulating lubricant, is executed on an inner face of the feeder head 16; the inner faces of the cavity 12*b*, which are constituted by the lower and the upper dies 14*a* and 14*b*, are not treated, and metal faces are exposed.

Conventionally, the heat insulating lubricant is usually used to coat the inner faces of the cavity, and it includes a high heat insulating material, e.g., ceramic. In the present embodiment, the conventional heat insulating lubricant is employed to coat the inner face of the feeder head 16.

Figure 3A:
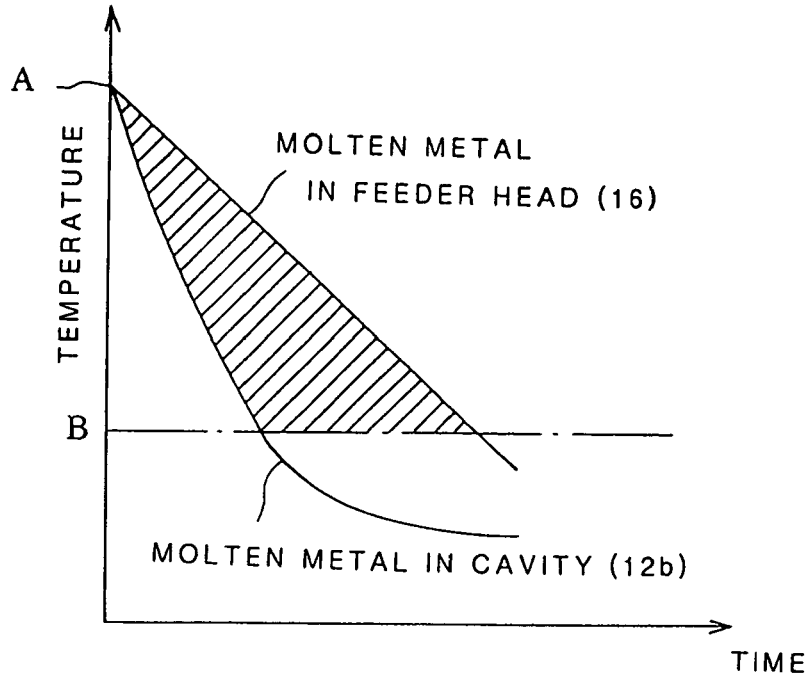
FIG. 3A is a graph showing temperature of a feeder head and a cavity of the casting machine shown in FIG. 1.

By making the heat insulating of the feeder head 16 greater than that of the cavity 12*b*, cooling rate of the molten metal in the feeder head 16 can be easily made lower than that of the molten metal in the cavity 12*b*, so that a great difference of the cooling rate can be make between the feeder head 16 and the cavity 12*b* (see FIG. 3A). In FIG. 3A, a point "A" is temperature of the molten metal, which is poured into the casting die 12; a point "B" is temperature of perfectly solidifying the molten metal. Therefore, the molten metal in the feeder head 16 can effectively fill the cavity 12*b* in a hatched temperature zone.

Figure 3B:
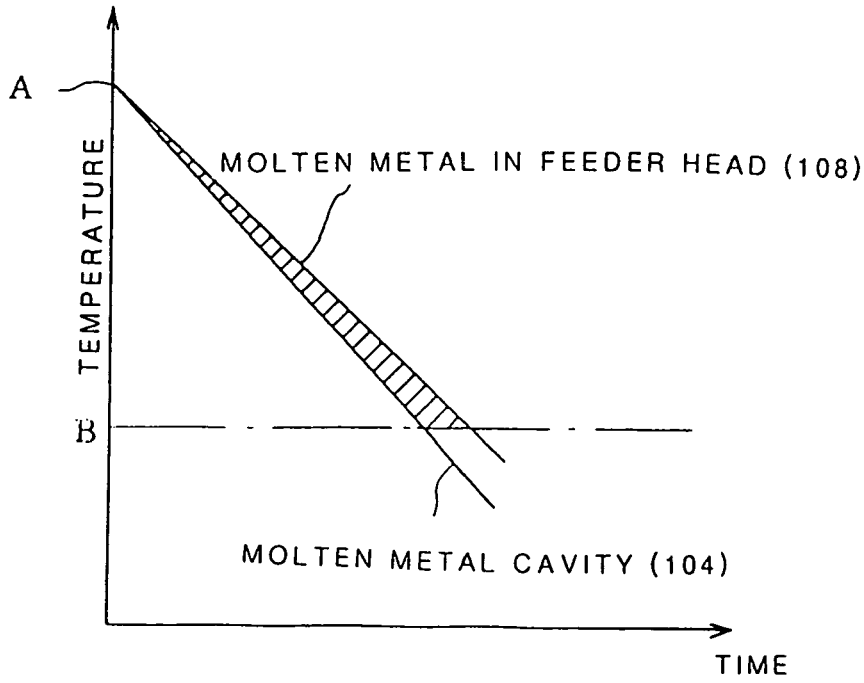
FIG. 3B is a graph showing temperature of the feeder head and the cavity of the conventional casting machine.
Figure 10:
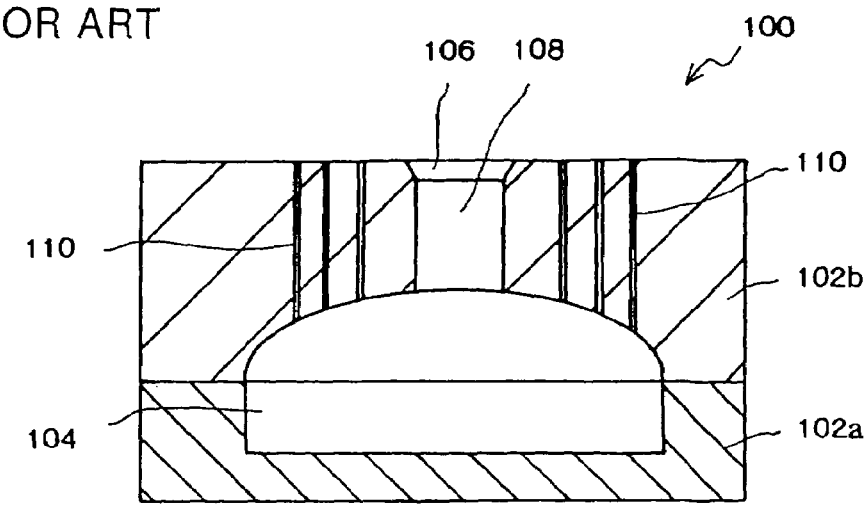
FIG.10 PRIOR ART
FIG. 10 is a sectional view of the casting die of the conventional casting machine.
Figure 11:
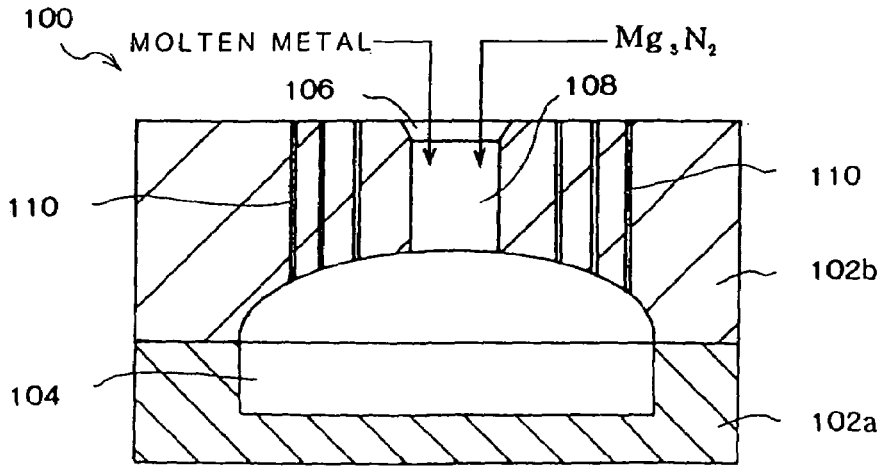
FIG.11 RELATED ART
FIG. 11 is an explanation view showing the method of casting, which has been invented by the inventor of the present invention.

On the other hand, in the conventional casting die 100 shown in FIG. 10, the inner faces of the feeder head 108 and the cavity 104 are coated with the heat insulating lubricant, and thickness of the lubricant on the feeder head 108 is thicker than that on the cavity 104, so that the cooling rate of the molten metal in the feeder head 108 can be made lower than that of the molten metal in the cavity 104 as shown in FIG. 3B.

However, as shown in FIG. 3B, the difference of the cooling rate in the casting die 100 is small, so the molten metal in the feeder head 108 cannot effectively fill the cavity 104. The hatched effective temperature zone is narrow.

As shown in FIG. 3A, in the casting die 12 of the present embodiment, the difference of the cooling rate is greater than that of the conventional casting die 100 (see FIG. 3B), and the effective temperature zone is also broader. Therefore, a difference of solidification speed between the molten metal in the feeder head 16 and the molten metal in the cavity 12*b* can be made. Namely, time lag can be made between solidification of the molten metal in the feeder head 16 and that of the molten metal in the cavity 12*b*.

To make enough time lag between the solidification of the molten metal in the feeder head 16 and that of the molten metal in the cavity 12*b* as shown in FIG. 3A, the cooling rate of the molten metal in the cavity 12*b* is 500° C./min. or more (preferably, 700° C./min. or more); the cooling rate of the molten metal in the feeder head 16 is less than 500° C./min. (preferably, less than 300° C./min.). Preferably, the difference between the cooling rate of the both is adjusted to 200° C./min or more.

Figure 4:
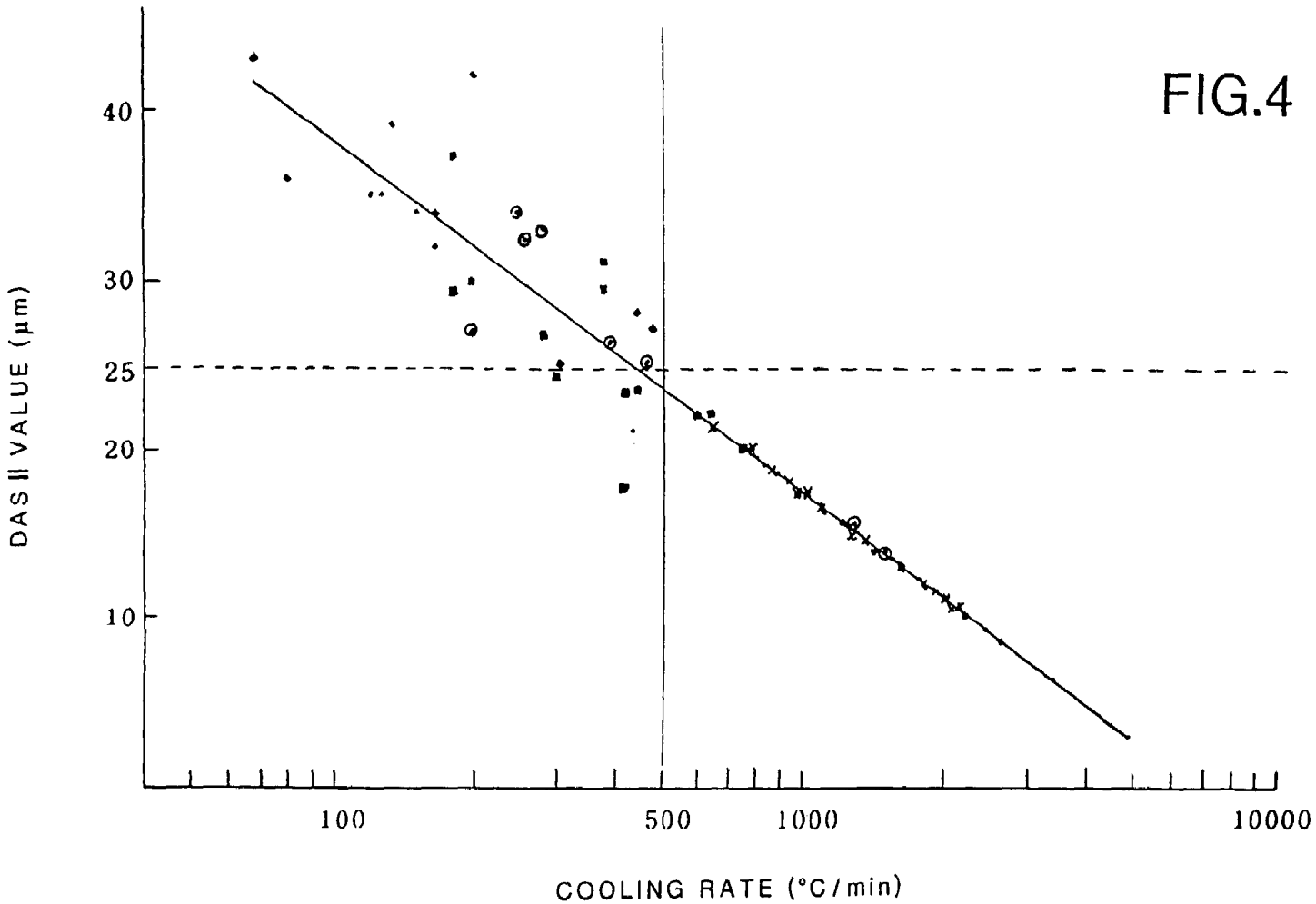
FIG. 4 is a graph showing a relationship between cooling rate of a molten aluminium and a clearance between dendrites of solidified aluminium.

Experiments were executed. In the experiments, a molten aluminium is used as the molten metal, and cooling rate of the molten metal in the feeder head 16 and the cavity 12*b* were varied. Samples of the solidified aluminum, which were taken from the feeder head 16 and the cavity 12*b*, were observed by a microscope and clearances between dendrites of the samples were measured. The results are shown in FIG. 4. In FIG. 4, the horizontal axis indicates the cooling rate; the vertical axis indicates "DAS II value" of the clearance between the dendrites.

As clearly shown in FIG. 4, an average clearance between the dendrites, which are solidified in the cavity 12*b* with the cooling rate of 500° C./min. or more, is less than 25 $\mu$m; an average clearance between the dendrites, which are solidified in the feeder head 16 with the cooling rate of less than 500° C./min., is 25 $\mu$m or more.

If the clearance between the dendrites is small, the solidified aluminium has a close-crystal structure, so that the cast aluminium product has greater toughness. Therefore, the preferable clearance between the dendrite of the aluminium in the cavity 12*b* is less than 23 $\mu$m, more preferably less than 20 $\mu$m.

Note that, the clearance between the dendrite of the aluminium in the feeder head 16 is wider than that in the cavity 12*b*. Therefore, toughness of the aluminium in the feeder head 16 is lower than that in the cavity 12*b*, but it will be removed from the cast product as a disused part, so no problem will be occurred.

When an aluminium product is cast in the casting machine 10 shown in FIGS. 1–2B, firstly the valve 24 is opened so as to introduce the nitrogen gas from the nitrogen gas cylinder 20 to the cavity 12*b* of the casting die 12 via the pipe 22. By introducing the nitrogen gas, air in the cavity 12*b* can be purged therefrom. The air in the cavity 12*b* is discharged from the air ventilation holes 25, so that a nitrogen atmosphere, which is a substantial non-oxygen atmosphere, can be produced in the cavity 12*b*. Then, the valve 24 is once closed.

While the air in the cavity 12*b* of the casting die 12 is purged, the valve 30 is opened so as to introduce the argon gas from the argon gas cylinder 20 to the furnace 28. With this action, a non-oxygen atmosphere is produced in the furnace 28.

Next, the valve 30 is closed and the valve 40 is opened so as to introduce the magnesium powders 36, which have been stored in the tank 36, into the furnace 28 together with the pressurized argon gas. The furnace has been heated to 800° C. or more, by the heaters 32, so as to sublime the magnesium powders. Therefore, the magnesium powders introduced in the furnace 28 are sublimed, and the magnesium gas is produced.

Then, the valve 40 is closed and the valves 30 and 45 are opened so as to introduce the magnesium gas into the cavity 12*b* via the pipe 42, the metallic gas inlet 12*c* of the casting die 12, the metallic gas path 23, the metal path 21 and the feeder head 16 together with the argon gas, whose pressure and amount of flow are controlled.

After the magnesium gas in introduced in the cavity 12*b*, the valve 45 is closed and the valve 24 is opened so as to introduce the nitrogen gas into the cavity 12*b* via the nitrogen gas inlet 12*d* and the paths 27. By introducing the nitrogen gas into the casting die 12, the magnesium gas is reacted on the nitrogen gas in the cavity 12*b*, so that a magnesium nitride compound ($Mg_3N_2$) can be produced. The magnesium nitride compound ($Mg_3N_2$) is deposited on the inner faces of the cavity 12*b* as powders.

When the nitrogen gas is introduced into the cavity 12*b*, pressure and amount of flow of the nitrogen gas are properly adjusted. To easily react the magnesium gas on the nitrogen gas, the nitrogen gas may be preheated so as to maintain the temperature of the casting die 12. Preferable time of reacting the gases is 5–90 sec., more preferably 15–60 sec.

While the magnesium nitride compound is stuck on the inner faces of the cavity 12*b*, the molten aluminium is poured into the cavity via the metal inlet 12*a*. The molten aluminium is introduced into the cavity 12*b* via the metal path 21 and the feeder head 16. The molten metal is continuously poured until the path 21 and the feeder head 16 are filled with the molten aluminium.

The molten aluminium in the cavity 12*b* contacts the magnesium nitride compound stuck on the inner faces of the cavity 12*b*, so that the magnesium nitride compound removes oxygen from the oxide film formed on the surface of the molten aluminium. By removing the oxygen, the surface of the molten metal can be deoxidized, and the product can be cast with pure aluminum.

Further, oxygen left in the cavity 12*b* reacts on the magnesium nitride compound, so that magnesium oxide or magnesium hydroxide is produced. The magnesium oxide or the magnesium hydroxide will be involved in the molten aluminium. The magnesium oxide or the magnesium hydroxide is stable compound and its amount is small, so it will not badly influence the product.

As described above, the magnesium nitride compound removes oxygen from the oxide film formed on the surface of the molten aluminum and produces pure alumiunm, so that the product can be cast without the oxide film. By removing the oxide film, the surface tension of the molten aluminium can be small, and the wettability, the fluidity and the running property of the molten aluminium can be improved. Therefore, the flat and smooth inner faces of the cavity 12*b* can be reproduced on the surfaces of the cast products, namely the cast products have good external shape having no crinkles and no surface detects.

The molten metal in the feeder head 16 and the cavity 12*b* are cooled to solidify. In the present embodiment, the inner face of the feeder head 16 is coated with the heat insulating lubricant; the inner faces of the cavity 12*b* is coated with no heat insulating lubricant, and the metallic material, which constitutes the lower and the upper dies 14*a* and 14*b*, is exposed therein. With this structure, the cooling rate of the molten metal in the cavity 12*b* is greater than that in the feeder head 16 (see FIG. 3A). Therefore, the molten metal in the cavity 12*b* can be solidified earlier than that in the feeder head 16.

When the molten metal in the cavity 12*b* is solidified, the solidified metal is shrinked so that a gap is formed in the cavity 12*b* and located close to the feeder head 16. On the other hand, the cooling rate in the feeder head 16 is less than that in the cavity 12*b*, so the molten metal is still left in the feeder head 16. Then, the molten metal left fills the gap in the cavity 12*b*, so that the good product having no surface defects, e.g., surface sink, can be cast.

Further, the lubricant for improving the fluidity of the molten metal, whose surface is covered with the oxide film, is not applied to the inner faces of the cavity 12*b*, so the surfaces of the product can be made very smooth.

Since the inner face of the feeder head 16 with the lubricant, the cooling rate of the feeder head 16 can be less than that of the cavity 12*b*, so enough time lag can be made between the solidification of the molten metal in the feeder head 16 and that in the cavity 12*b*, and the volume of the feeder head 16 can be smaller. Therefore, the disused part of the cast product, which is formed into the pillar-shape and will be removed from the product, can be smaller, yield of the molten metal can be improved, and energy consumption can be reduced.

In the casting die 12 shown in FIGS. 1–2B, the molten metal in the feeder head 16 is introduced into the cavity 12*b* by gravity. The molten metal may be compulsorily exerted. For example, as shown in FIG. 2A, the adapter 18 of the casting die 12 is detachably attached to the upper die 14*b*. When the molten metal in the cavity 12*b* is solidified, the adapter 18 is detached and the molten metal in the feeder head 16 is compulsorily pressed. With this press action, the molten metal is exerted to fill the cavity 12*b*, so that the good product having no surface defects, e.g., surface sink, can be securely cast.

The molten metal in the feeder head 16 should be pressed when the molten metal in the cavity 12*b* is substantially solidified and the molten metal in the feeder head 16 still has enough fluidity. The best timing of pressing the molten metal in the feeder head 16 depends on designs of the casting dies, so the best timing of the casting die 12 should be previously known by experiments.

A piston 35 (see FIG. 5), which is capable of moving in the vertical direction, may be used as means for pressing the molten metal in the feeder head 16.

In the casting die 12 shown in FIGS. 1–2B and 5, the feeder head 16 is formed in the upper die 14*b*. The solidified metal in the feeder head 16 is the disused part and will be removed from the product, so the feeder head 16 may be formed in other parts of the casting die 12. For example, the feeder head 16 may be formed by the adapter 18, which is made of the baked calcium sulfate, and the upper die 14*b*. In this case, heat conductivity of the adapter 18 is lower than that of the metallic lower die 14*b*. Namely, the adapter 18 has high heat insulating, so volume of the adapter 18 in the adapter 18 is greater than that of the other part of the feeder head 16 in the upper die 14*b* (see FIG. 6). With this structure, the heat insulating of the feeder head 16 can be made greater than that of the cavity 12*b*, which is formed in the lower and the upper dies 14*a* and 14*b*, without applying the heat insulating lubricant on the inner faces of the feeder head 16.

Figure 5:
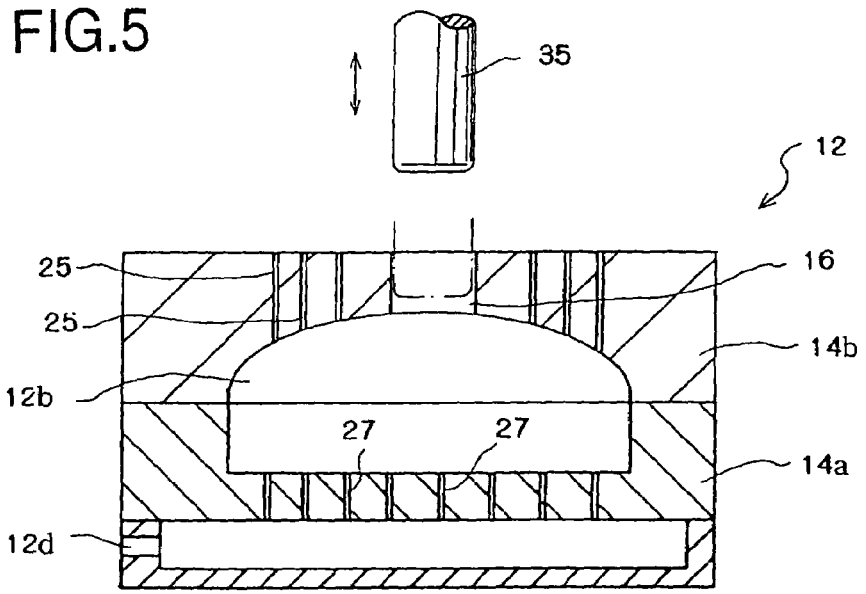
FIGS. 5–7 are sectional views of other examples of the casting die.
Figure 6:
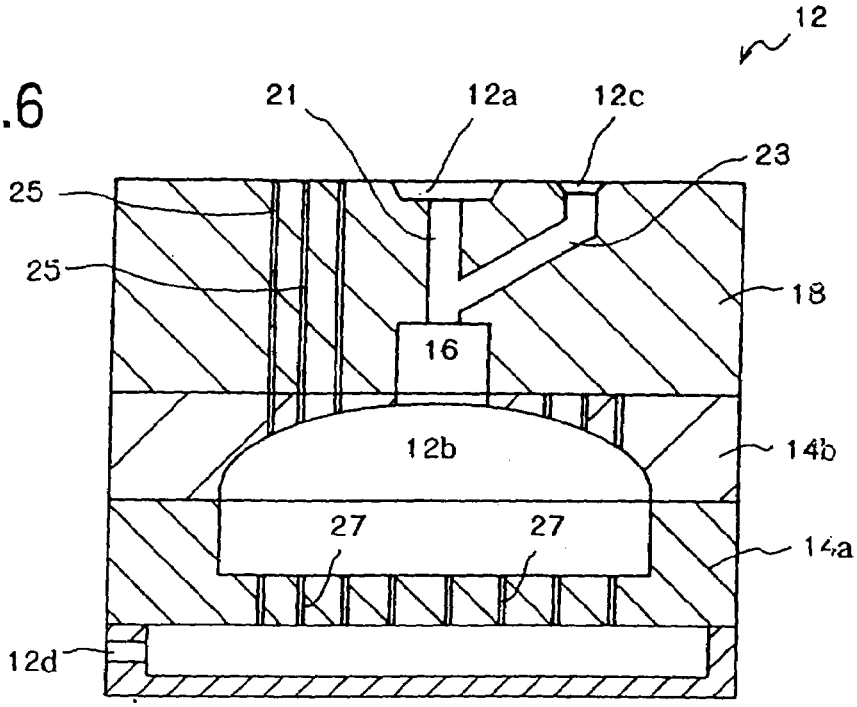

When the molten metal in the feeder head 16 is pressed as shown in FIG. 5, an heat insulating plate 37 (see FIG. 7), whose heat conductivity is lower than that of the metallic dies 14*a* and 14*b*, may be provided between the adapter 18 and the upper die 14*b*. In this case, the feeder head 16 is formed by the heat insulating plate 37 and the upper die 14*b*.

The hear insulating plate 37 can be detached from the adapter 18, and the heat insulating plate 37 can be detached from the upper die 14*b*. With this structure, the adapter 18 is detached and the molten metal in the feeder head 16 can be pressed by the pressing means, e.g., the piston 35 (see FIG. 5), when the molten metal in the cavity 12*b* is solidified.

Figure 7:
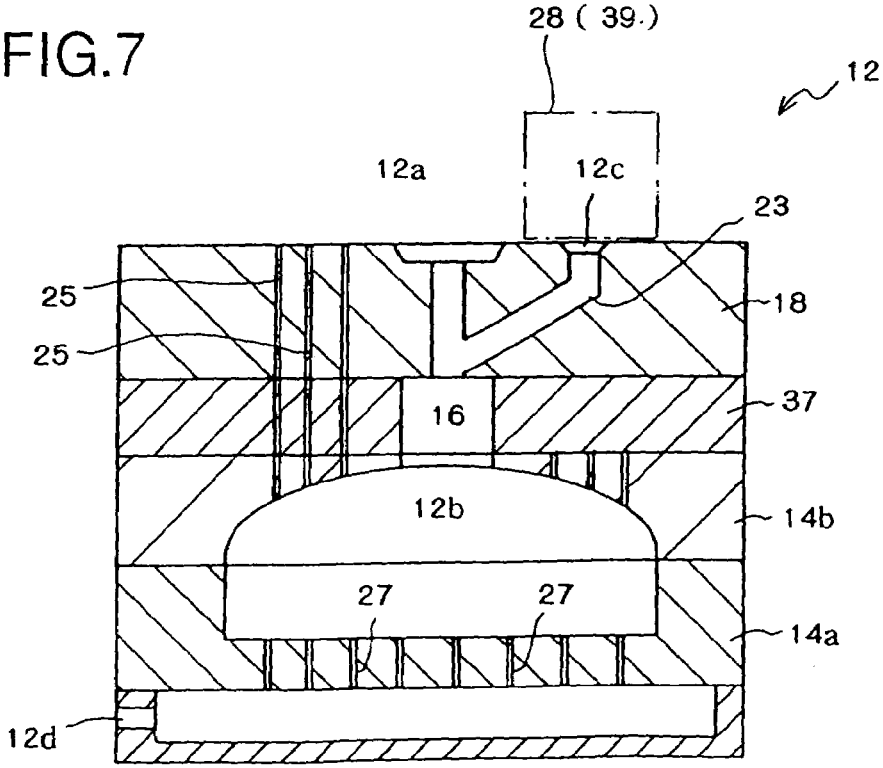

The hear insulating plate 37 may be made of baked calcium sulfate. As shown in FIG. 7, volume of a part of the feeder head 16 formed in the plate 37 is greater than that of the other part of the feeder head 16 formed in the upper die 14*b*. With this structure, the heat insulating of the feeder head 16 can be made greater than that of the cavity 12*b*, which is formed in the metallic dies 14*a* and 14*b*, without applying the heat insulating lubricant on the inner faces of the feeder head 16.

In the casting die 12 shown in FIGS. 1–2B and 5–7, the adapter 18 and the heat insulating plate 37 are made of the baked calcium sulfate, but they may be made of metals or ceramics.

Note that, in the case of employing the metallic adapter 18 or the metallic plate 37, in which the feeder head 16 is substantially formed, the inner face of the feeder head is coated with the heat insulating lubricant so as to make the heat insulating of the feeder head 16 greater than that of the cavity 12*b*.

As shown in FIG. 7, the furnace 28 shown in FIG. 1 may be provided immediately above the metallic gas inlet 12*c* of the casting die 12. In another case, a reaction chamber 39, in which the magnesium gas, which is an example of the metallic gas, is reacted on the nitrogen gas, which is an example of the reacting gas, so as to produce the magnesium nitride compound ($Mg_3 N_2$), which is an example of the deoxidizing compound, may be provided immediately above the metallic gas inlet 12*c* of the casting die 12.

When the aluminium product is cast in the casting die 12 shown in FIGS. 1–7, temperature of the inner faces of the cavity 12*b* is lower than 320° C., which is temperature of the inner faces of the cavity of the conventional casting die. In the present invention, the temperature of the inner faces of the cavity 12*b* is maintained less than 300° C. while casting, preferably less than 230° C., more preferably less than 200° C.

By making the temperature of the inner faces of the cavity 12*b* of the casting die 12 lower, the casting machine of the present invention has many advantages: the cooling rate of the molten metal can be made higher; the molten metal can be uniformly solidified; the volume of the feeder head 16 can be reduced; tough products can be cast; cycle time of casting can be shorter; casting efficiency can be improved; and life span of the casting die can be longer.

If the temperature of the inner faces of the cavity 12*b* is higher than the prescribed temperature, the casting die 12 should be compulsorily cooled. For example, the casting die 12 can be cooled by a cooling unit 47 shown in FIG. 8. The cooling unit 47 includes water jackets 12*e*, which is provided to the casting die 12 and in which water or oil is circulated. The temperature of the casting die 12 is measured by proper means, e.g., a thermocouple, and the cooling unit 47 is driven when the measured temperature is higher than the prescribed temperature so as to maintain the temperature of the casting die 12 in a predetermined temperature range.

In the case of compulsorily cooling the casting die 12, the lowest temperature of the inner faces of the cavity 12*b* is not limited, so it may be the room temperature. Preferably, the temperature range is defined so as to economically operating the cooling unit 47.

Figure 8:
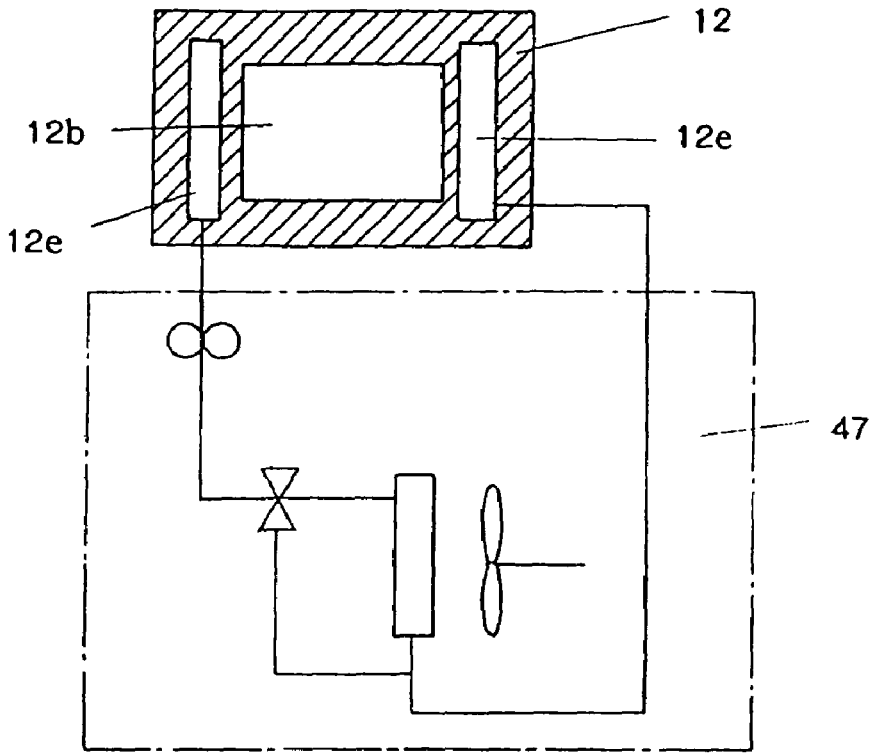
FIG. 8 is an explanation view showing an outline of an example of a cooling unit.

If the temperature of the inner faces of the cavity 12*b* is higher than the prescribed temperature in spite of employing the cooling unit 47 shown in FIG. 8, cold water, which have been cooled by a cooler 64 (see FIG. 9) may be circulated in the water jackets 12*e*. In the cooling unit 47 shown in FIG. 9, the cold water is once reservoired in a tank 60 and circulated in the water jackets 12*e* by a pump 62. The water in the tank 60 is cooled by the cooler 64, whose structure is publicly known. In some cases, the cooler 64 cools to temperature of −25° C., so antifreezing solution is employed instead of water.

Figure 9:
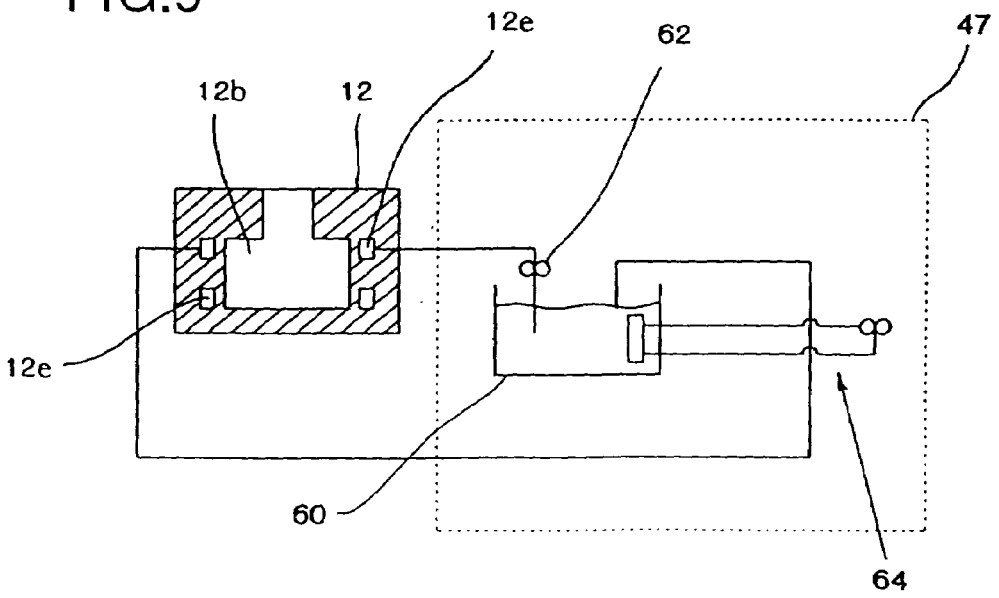
FIG. 9 is an explanation view showing an outline of another example of the cooling unit.

By employing the cooling unit 47 shown in FIG. 9, the temperature of the inner faces of the cavity 12*b* can be maintained lower than the room temperature, so that the solidification of the molten metal in the cavity 12*b* of the casting die 12 can be accelerated and crystal structures, e.g., dendrites, of the solidified metal are made finer. Further, the molten metal is rapidly cooled, so that the crystal structures are made close and compact and hardness of the cast products can be improved.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. A casting machine, comprising a gravity casting die, which comprises:

a metal inlet, from which a molten metal is poured into said casting die;

a cavity, in which the molten metal is solidified so as to cast a product; and a feeder head being provided between said metal inlet and said cavity, in which heat insulating of the feeder head is greater than that of said cavity so as to make cooling rate of said feeder head lower than that of said cavity, wherein the molten metal is reacted on a deoxidizing compound introduced by a means for introducing constituents to form the deoxidizing compound in said cavity so as to deoxidize an oxide film formed on a surface of the molten metal, and the molten metal in said feeder head is supplemented to said cavity when the molten metal in said cavity is solidified and shrinked, wherein the cavity has a thermal conductivity which produces a cooling rate of the molten metal in the cavity to be 500° C./min. or more, and the feeder head has a thermal conductivity which provides a cooling rate of the molten metal in the feeder head to be less than 500° C./min.

2. The casting machine according to claim 1, wherein the molten meal is aluminium or aluminium alloy, the cooling rate of the molten metal in said cavity is adjusted to make average clearance between dendrites of solidified aluminium or aluminium alloy in said cavity less than 25 $\mu$m, and the cooling rate of the molten metal in said feeder head is adjusted to make average clearance between dendrites of solidified aluminium or aluminium alloy in said feeder head 25 $\mu$m or more.

3. The casting machine according to claim 1, wherein an inner face of said feeder head is coated with heat insulating lubricant, and an inner face of said cavity is devoid of a heat insulating lubricant.

4. The casting machine according to claim 1, wherein heat insulating of a material of said casting die, which forms said feeder head, is greater than that of a material of said casting die, which forms said cavity.

5. The casting machine according to claim 1, further comprising means for compulsorily cooling an inner face of said cavity.

6. The casting machine according to claim 1, wherein an adapter of said casting die is detachably attached to a cavity part of said casting die.

7. The casting machine according to claim 1, wherein an adapter of said casting die includes: said feeder head; a first path for introducing the molten metal to said feeder head; and a second path for introducing a material of the deoxidizing compound to said cavity so as to form the deoxidizing compound in said cavity.

8. The casting machine according to claim 1, wherein volume of said feeder head is 5–20% of volume of said cavity.

9. A casting machine, comprising a gravity casting die, which includes:

a metal inlet, from which a molten metal is poured into said casting die;

a cavity having an uncoated portion; and a feeder head being provided between said metal inlet and said cavity, wherein the molten metal is reacted on a deoxidizing compound introduced by a means for introducing constituents to form the deoxidizing compound in said cavity so as to deoxidize an oxide film formed on a surface of the molten metal, and, wherein the uncoated portion of the cavity has a thermal conductivity which produces a cooling rate of the molten metal in the cavity to be 500° C./min. or more, and the feeder head has a thermal conductivity which provides a cooling rate of the molten metal in the feeder head to be less than 500° C./min.

10. The casting machine according to claim 9, wherein the molten metal in said feeder head is supplemented to said cavity when the molten metal in said cavity is solidified and shrinked.

11. The casting machine according to claim 9, wherein heat insulating of the feeder head is greater than that of said cavity so as to make the cooling rate of said feeder head lower than that of said cavity.

12. A gravity die casting machine, comprising:

a metal inlet, from which a molten metal is poured into a casting die;

a cavity, in which the molten metal is solidified so as to cast a product;

a feeder head being provided between said metal inlet and said cavity, in which heat insulating of the feeder head is greater than that of said cavity so as to make cooling rate of said feeder head lower than that of said cavity; and a heated receptacle providing a substance of a reducing compound into the cavity to reduce an oxide film formed on a surface of the molten metal;

wherein the molten metal is reacted on the reducing compound in said cavity so as to deoxidize an oxide film formed on a surface of the molten metal, and the molten metal in said feeder head is supplemented to said cavity when the molten metal in said cavity is solidified and shrinked, and wherein the cavity has a thermal conductivity which produces a cooling rate of the molten metal in the cavity to be 500° C./min. or more, and the feeder head has a thermal conductivity which provides a cooling rate of the molten metal in the feeder head to be less than 500° C./min.

13. The casting machine according to claim 12, wherein the cooling rate of an uncoated portion of said cavity is 500° C./min or more and the cooling rate of said feeder head is less than 500° C./min.

14. A gravity casting machine comprising:

a metal inlet, from which a molten metal is poured into a casting die;

a cavity, in which the molten metal is solidified so as to cast a product;

a feeder head being provided between said metal inlet and said cavity, the cavity having a higher cooling rate than the feeder head;

a first receptacle providing a first substance of a deoxidizing compound into said cavity; and a second receptacle for introducing a second substance in the cavity, separate from the first substance, to mix with the first substance in said cavity to form the deoxidizing compound so as to deoxidize an oxide film formed on a surface of the molten metal, wherein an uncoated portion of the cavity has a thermal conductivity which produces a cooling rate of the molten metal in the cavity to be 500° C./min. or more, and the feeder head has a thermal conductivity which provides a cooling rate of the molten metal in the feeder head to be less than 500° C./min.

15. The casting machine according to claim 14, wherein said first receptacle is a heated receptacle.

16. The casting machine according to claim 14, wherein said first receptacle is a furnace.

17. The casting machine according to claim 14, wherein:

said first receptacle is connected to a first path connecting to said cavity for introducing the first substance of the deoxidizing compound to said cavity, and said second receptacle is connected to a second path connecting to said cavity for introducing the second substance of the deoxidizing compound to said cavity so as to form the deoxidizing compound in said cavity.

* * * * *

UNITED STATES PATENT AND TRADEMARK OFFICE

CERTIFICATE OF CORRECTION

PATENT NO. : 6,964,293 B2
APPLICATION NO. : 10/858478
DATED : November 15, 2005
INVENTOR(S) : K. Ban et al.

It is certified that error appears in the above-identified patent and that said Letters Patent is hereby corrected as shown below:

At column 11, line 5 (claim 2, line 2) of the printed patent, “meal” should be --metal--.

Signed and Sealed this

Eleventh Day of July, 2006

JON W. DUDAS
*Director of the United States Patent and Trademark Office*